US005517724A

United States Patent [19]

Beneke

[11] Patent Number: 5,517,724

[45] Date of Patent: May 21, 1996

[54] HINGE FOR PIECES OF FURNITURE

[75] Inventor: Ulrich Beneke, Bünde, Germany

[73] Assignee: Paul Hettich G.m.b.H. & Co., Kirchlangern, Germany

[21] Appl. No.: 308,586

[22] Filed: Sep. 19, 1994

[30] Foreign Application Priority Data

Sep. 23, 1993 [DE] Germany ..... 9314375 U

[51] Int. Cl.[6] ..... E05D 11/10

[52] U.S. Cl. ..... 16/335; 16/296

[58] Field of Search ..... 16/335, 296, 297, 16/286

[56] References Cited

U.S. PATENT DOCUMENTS

| | | | |
|---|---|---|---|
| 4,114,236 | 9/1978 | Vandervort | 16/335 |
| 4,716,622 | 1/1988 | DeBruyn | 16/335 |
| 4,819,299 | 4/1989 | Holan | 16/278 |
| 5,027,474 | 7/1991 | Bowers | 16/335 |
| 5,355,557 | 10/1994 | Cress et al. | 16/335 |

*Primary Examiner*—Chuck Y. Mah
*Attorney, Agent, or Firm*—Henry M. Feiereisen

[57] ABSTRACT

A hinge for use in a piece of furniture includes a casing adapted for attachment to a door of the piece of furniture and having a bottom provided with a bump, and a support member for attachment to a wall of the piece of furniture and including at least one bearing insert projecting into the casing for defining at least one joint connection between the support member and the casing. In the area of the joint connection, the bearing insert includes a peripheral cam which cooperates with a closing and locking member in form of a flat spring during opening motion of the hinge. The flat spring is located the area of the casing bottom, approximately parallel thereto, with the central area of the flat spring being supported by the bump of the casing bottom.

14 Claims, 3 Drawing Sheets

HINGE FOR PIECES OF FURNITURE

BACKGROUND OF THE INVENTION

The present invention refers to a hinge for pieces of furniture, and in particular to a hinge of the type including a casing which is attached to a door of a piece of furniture, and a support member which is attached to a wall of the piece of furniture and includes at least one bearing insert projecting into the casing for defining at least one joint connection between the support member and the casing and including in the area of the joint connection a peripheral cam-like control surface which cooperates with a closing and locking member in form of a flat spring during opening of the hinge.

In conventional hinges of the above stated type, the flat spring, e.g. in form of a leaf spring, protrudes relatively deep into the casing space which adversely affects the overall optical appearance. Moreover, the prestress of the flat spring is effected by a special construction which is integrated with the remaining operational parts of the hinge and is relatively expensive. Also, because this special construction forms an integral part of the hinge, its use becomes necessary even though in some special cases there is no need for a closing or locking unit,

SUMMARY OF THE INVENTION

It is an object of the present invention to provide an improved hinge, obviating the afore-stated drawbacks.

In particular, it is an object of the present invention to provide an improved hinge with a closing and locking unit which does not adversely affect the optical aesthetic of the hinge and can be produced and mounted in a simple and inexpensive manner while allowing, especially when the type of hinge is of simple basic structure, a selective use without any problem if required.

These objects and others which will become apparent hereinafter are attained by arranging the flat spring in the area of the casing bottom approximately parallel thereto, and by supporting the flat spring in its central area by a bump of the casing bottom.

The arrangement in proximity of and parallel to the casing bottom renders the flat spring essentially unnoticeable so that the overall optical appearance of the piece of furniture is not adversely affected in the area of the binge and the value of the piece of furniture appreciates.

The basic design of the hinge with its remaining operational elements requires only insignificant modifications. In a most simple embodiment, the central area of the flat spring is supported by a small bead formed in the casing bottom. Such designs allow the provision of hinges with or without closing and looking units. At use, the flat spring can easily be attached.

In accordance with a preferred version of the present invention, the cam-distant end of the flat spring traverses a small opening in the casing bottom and is supported at its underside. This, too, renders the basic design of the hinge simple and results in a very simple and inexpensive closing and locking unit which can easily be attached and yet is reliable and wear-resistant.

Preferably, the cam-distant end of the flat spring is acted upon by an adjusting member for allowing a modification of the distance between the casing bottom and the flat spring and a presetting and readjusting of the closing and locking force of the flat spring. The adjusting member can be of any suitably design e.g. in form of a screw which traverses the casing bottom and rests with a shoulder on the flat spring. Other examples for an adjusting member include a rotatable disk with an ascending or descending end face for support of the flat spring, or a linearly displaceable wedge which is provided with grooves.

In accordance with another preferred feature of the present invention, the spring force can be easily controlled through providing the bump for support of the central area of the flat spring in form of an insert which is selectively engageable in one of several, spaced receiving openings in the casing bottom. The insert is of such dimension as to project beyond the width of the bottom to allow contact with the flat spring. Thus, depending on the selection of engagement of the insert in one of the receiving openings, the point of supped and thus the tilting point of the flat spring can be modified.

Any type of hinge regardless of the number of pivot points, pivot axes and articulated levers can be designed in a manner according to the present invention.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
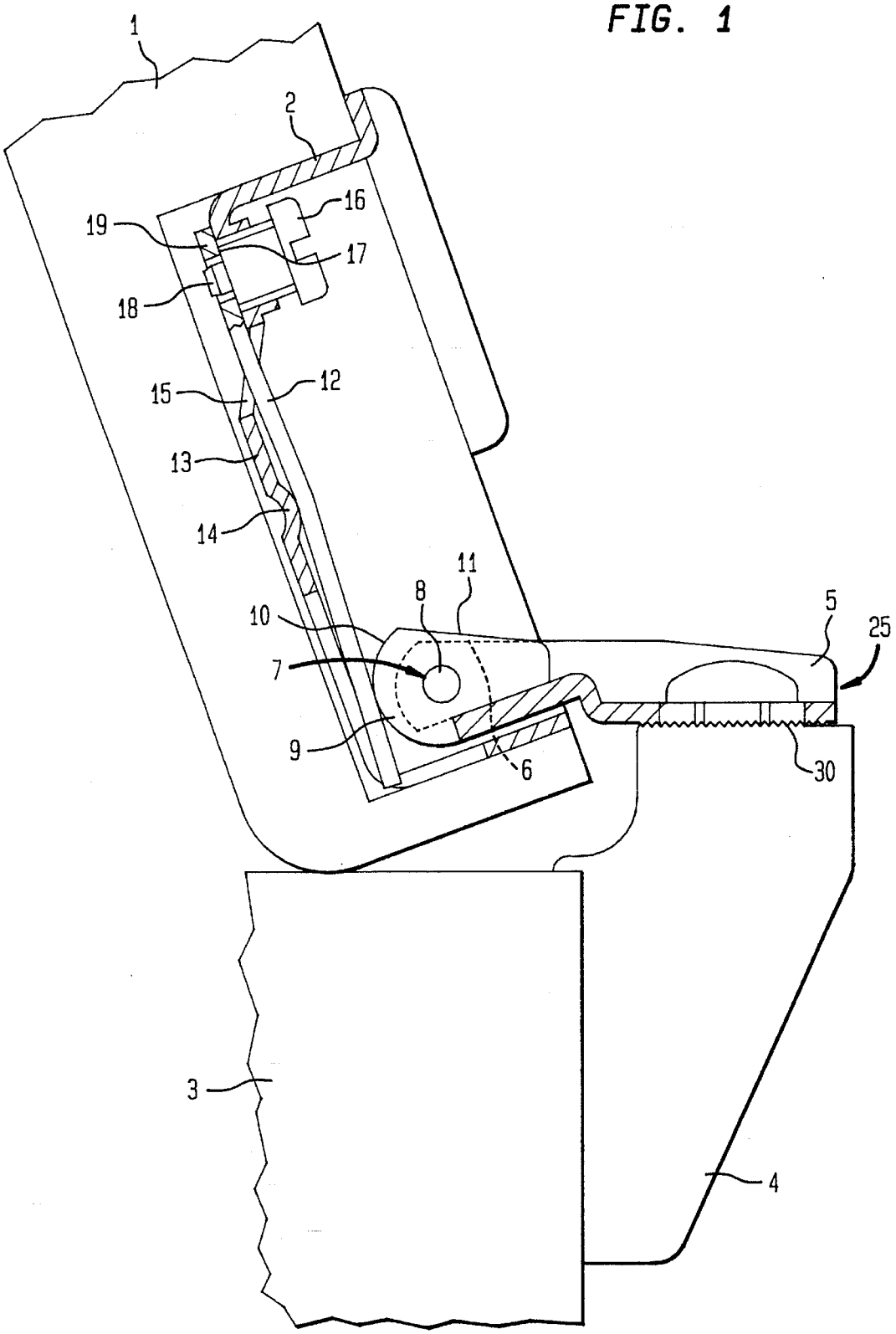
FIG. 1 is a partially sectional view of one embodiment of a hinge according to the present invention, with the hinge occupying an open position.

Throughout all the Figures, the same or corresponding elements are always indicated by the same reference numerals.

Turning now to the drawing, and in particular to FIG. 1, there is shown a partially sectional view of one embodiment of a hinge according to the present invention, including a casing 2 which is securable to e.g. a door 1 of a piece of furniture, and a support member which is generally designated by reference numeral 25 and includes a mounting plate 4, which is attachable e.g. through screw fasteners to a wall of the piece of furniture 3, and a side piece 5 which is secured to the mounting plate 4 via a screw fastener and mating fluting 30. The side piece 5 of the support member 25 is provided with at least one bearing insert 6 which projects into the casing 2 such that a bearing point 7, for example for a pivot axis 8, is defined to thereby effect a joint connection between the support member 25 and the casing 2. On its end projecting into the casing 2, the side piece 5 is provided with a pressure piece 9 which is provided at its free end with a peripheral cam-like control surface 10 which is followed by a flat stop surface 11.

Accommodated in the casing 2 is a closing and locking unit in form of a flat spring which in the nonlimiting example of FIG. 1 is a single leaf spring 12. The leaf spring 12 is situated in the less visible area of the bottom 13 of the casing 2, approximately parallel thereto, and is supported with its central area by a bump or raised part 14 of the bottom 13. In the nonlimiting example of FIG. 10 the bump 14 is simply formed by a bead in the bottom 13.

Figure 2:
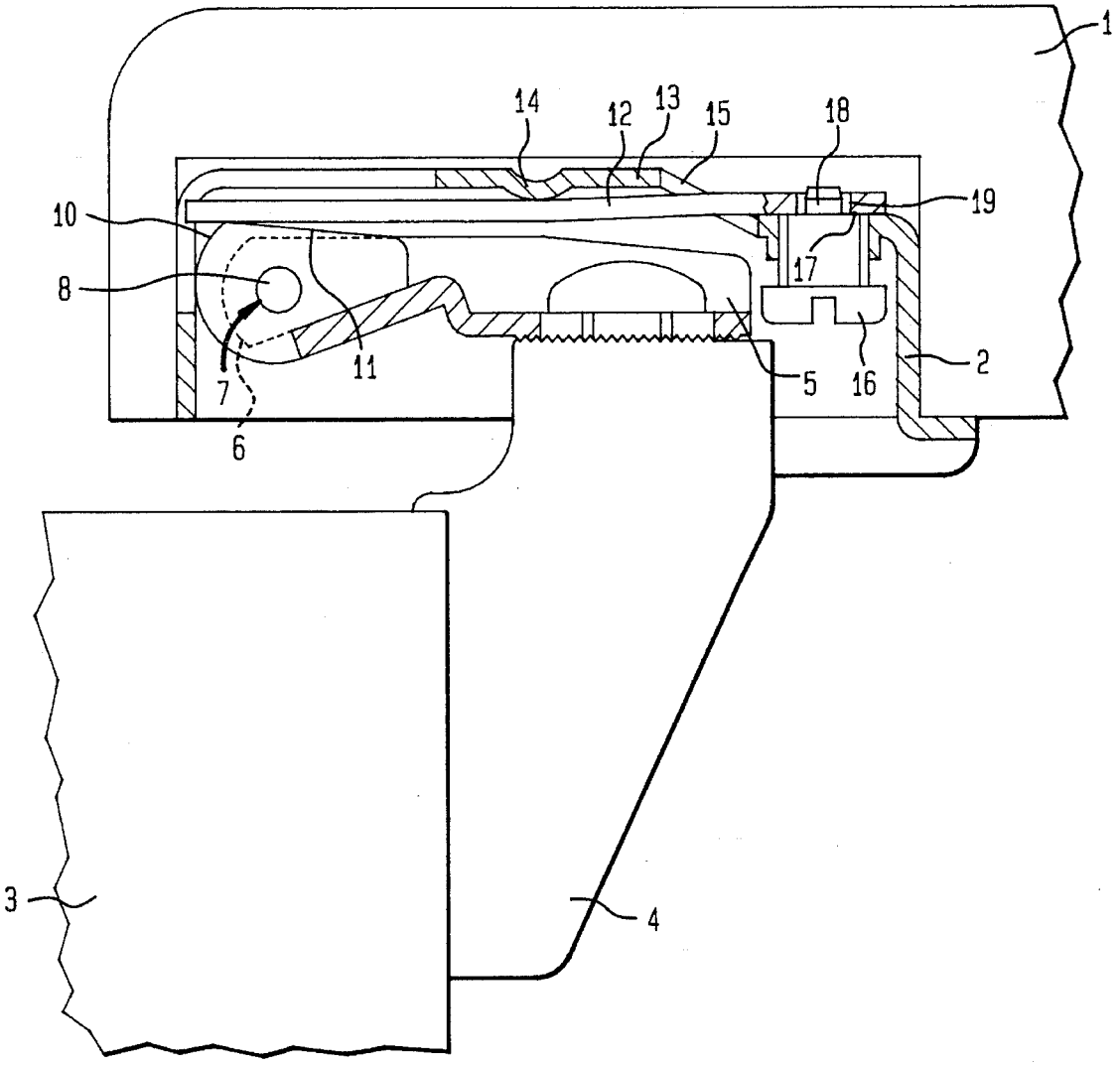
FIG. 2 is a partially sectional view of the hinge of FIG. 1 in closing position.

FIG. 1 illustrates the opening position of the hinge in which one end of the leaf spring 12 bears at respective prestress upon the peripheral cam 10. When closing the door 1, as shown in FIG. 2, the leaf spring 12 rests upon the stop surface 11 of the pressure piece 9.

The other end of the loaf spring 12 traverses an opening 15 of the bottom 13 and is supported upon the facing underside of the bottom 13. As further shown in FIG. 1, the cam-distant end of the leaf spring 12 is acted upon by an adjusting member in form of a screw 16 which is engaged in a threaded opening of the bottom 13 and rests with a shoulder 17 upon the leaf spring 12. By means of the screw 16, the distance between the leaf spring 12 and the bottom 13 and thus the prestress of the leaf spring 12 can be modified.

The screw 16 is further provided at its lower end with a pin 18 which traverses a bore 19 of the leaf spring 12 to secure the leaf spring 12 against unintentional displacement.

Figure 4:
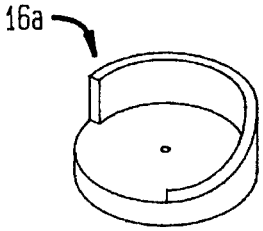
FIGS. 4 and 5 are detailed illustrations of further designs of an adjusting member for cooperation with a flat spring used in a hinge according to the present invention.
Figure 5:
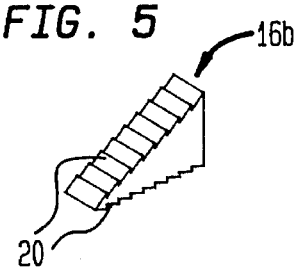
Figure 9:
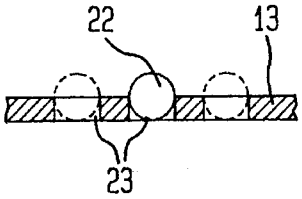
FIG. 9 is a fragmentary sectional view of a hinge according to the present invention, showing only the casing bottom with variable support for the flat spring.

Persons skilled in the art will understand that the screw 16 is shown only by way of example and may be substituted by any other suitable adjusting member. Examples of further adjusting members are illustrated in FIGS. 4 and 5. The adjusting member in FIG. 4 is a disk **16*a* which has an ascending or descending end face for support of the flat spring 12. The disk 16*a* may e.g. be rotatably supported in the casing bottom 13, with the end face being directed downwards toward the flat spring 12. In order to allow an easy turning, the top face of the disk 16*a* may be provided with a slot for attachment of a screwdriver. The adjusting member according to FIG. 5 is a wedge 16*b* which is linearly movable underneath the bottom 13, with the bottom 13 being provided with a longitudinal slot (not shown) through which the wedge 16*b* is guided for displacement. Suitably, the wedge 16*b* is provided with grooves 20 across its effective surfaces for securing the position of the wedge 16*b* relative to the bottom 13. The distance between the flat spring 12 and the bottom 13 cart thus be modified through a shift of the wedge 16*b***.

Figure 3:
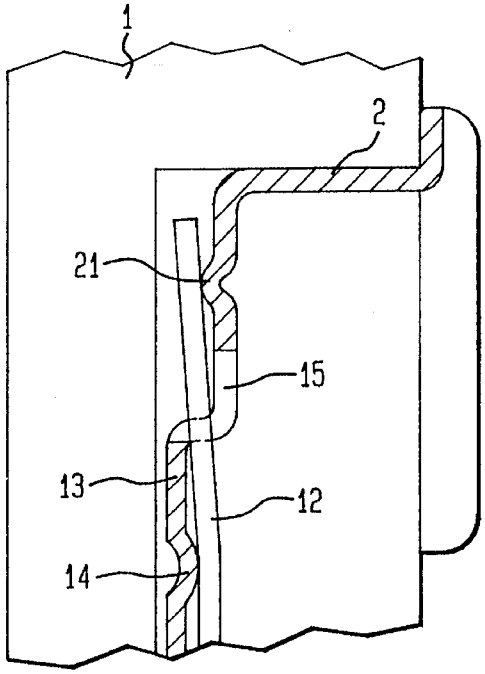
FIG. 3 is a fragmentary, partially sectional view of another embodiment of a hinge according to the present invention.

FIG. 3 shows a simplified version of the hinge according to FIG, 1, with the difference residing in the omission of an adjusting member, in this particular simple design, the cam-distant end of the bottom 13 is slightly offset relative to the forward part, and the leaf spring 12 is directly supported by the cam-distant end of the bottom 13 which suitably is provided with a downwardly projecting bead 21 to impart the leaf spring 12 with a required prestress.

Figure 6:
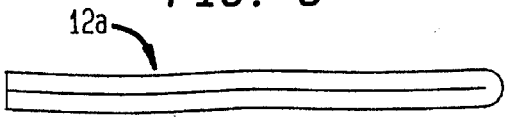
FIGS. 6 to 8 are illustrations of various further designs of a flat spring.
Figure 7:
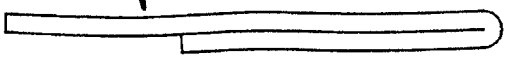
Figure 8:
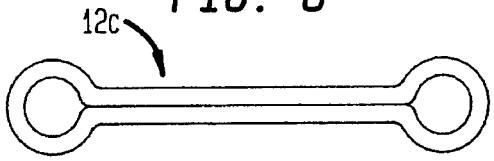

FIGS. 6, 7, and 8 illustrate further examples of flat springs, with FIG. 6 showing a leaf spring **12*a* which is bent on one end to form two layers. FIG. 7 depicts a leaf spring 12*b* which is also bent on one end but is of two layers only over a portion thereof. The flat spring 12*c* according to FIG. 8** is designed as a wire strap type spring.

A further possibility to affect the prestress of the flat spring 12 is shown in FIG, 9 in which the casing bottom 13 is provided with a plurality of spaced receiving openings 23 for selective engagement by an insert, e.g. a wire pin 22, which forms a support for the central area of the flat spring 12. Through selectively engagement of the wire pin 22 in one of the receiving openings 23, the point of support of the flat spring 12 relative to its longitudinal extension and thus its tilting point can be modified.

While the invention has been illustrated and described as embodied in a hinge for pieces of furniture, it is not intended to be limited to the details shown since various modifications and structural changes may be made without departing in any way from the spirit of the present invention.

What is claimed as new and desired to be protected by Letters Patent is set forth in the appended claims:

I claim:

1. A hinge for use in pieces of furniture, comprising:

a casing adapted for attachment to a door of a piece of furniture and having a bottom provided with a bump;

a support member for attachment to a wall of the piece of furniture and including at least one bearing insert projecting into said casing for defining at least one joint connection between said support member and said casing and including a peripheral cam in the area of the joint connection;

a closing and locking means in form of a flat spring having one end cooperating with said peripheral cam during opening of the hinge and another end, said flat spring being arranged in the area of said bottom of said casing at approximately parallel relationship thereto and defining a central area which is supported by said bump of said bottom, and an adjusting member situated at said other end of said flat spring for allowing a modification of a distance between said bottom and said flat spring.

2. A hinge as defined in claim 1 wherein said flat spring has another, end which traverses an opening in said bottom and is supported by an underside of said bottom.

3. A hinge as defined in claim 1 wherein said adjusting element is a screw acting upon said flat spring.

4. A hinge as defined in claim 3 wherein said screw threadably engages said bottom to act with a shoulder upon said flat spring.

5. A hinge as defined in claim 3 wherein said screw has a lower end provided with a pin which engages a bore of said flat spring.

6. A hinge as defined in claim 1 wherein said flat spring is a single leaf spring.

7. A hinge as defined in claim 1 wherein said flat spring is designed at least partly as two-layer leaf spring.

8. A hinge as defined in claim 1 wherein said flat spring is designed as a wire strap type spring.

9. A hinge as defined in claim 1 wherein said adjusting member is a rotatable disk with an ascending or descending end face for support of said flat spring.

10. A hinge as defined in claim 1 wherein said adjusting member is a linearly displaceable wedge.

11. A hinge as defined in claim 10 wherein said wedge has effective surfaces provided with grooves.

12. A hinge as defined in claim 1 wherein said bump of said bottom is created by a bead formed in said bottom.

13. A hinge as defined in claim 1 wherein said bottom is provided with several spaced receiving openings, said bump of said bottom being formed by an insert which is selectively engageable in one of said receiving openings in said bottom.

14. A hinge as defined in claim 1 wherein said supped member includes a pressure piece having a stop surface, said peripheral cam being formed on said pressure piece and continues into said stop surface which supports said flat spring in closing position.

* * * * *

UNITED STATES PATENT AND TRADEMARK OFFICE

CERTIFICATE OF CORRECTION

PATENT NO. : 5,517,724

DATED : May 21, 1996

INVENTOR(S) : Ulrich Beneke

It is certified that error appears in the above-indentified patent and that said Letters Patent is hereby corrected as shown below:

Column 1, line 54, change "looking" to --locking;

Column 2, line 16, change "supped" to --support--;

Column 4, claim 14, line 61, change "supped" to --support--;

Column 4, claim 2, line 32, change "another, end" to --another end--.

Signed and Sealed this

Tenth Day of September, 1996

*Attest:*

Bruce Lehman

BRUCE LEHMAN

*Attesting Officer*

*Commissioner of Patents and Trademarks*